US011139595B1

(12) United States Patent
Zhang

(10) Patent No.: US 11,139,595 B1
(45) Date of Patent: Oct. 5, 2021

(54) SPRING LOADED LOCKING CLAMP FOR JUMPER CABLES

(71) Applicant: Jian Zhang, Brampton (CA)

(72) Inventor: Jian Zhang, Brampton (CA)

( * ) Notice: Subject to any disclaimer, the term of this patent is extended or adjusted under 35 U.S.C. 154(b) by 0 days.

(21) Appl. No.: 16/826,582

(22) Filed: Mar. 23, 2020

(51) Int. Cl.
*H01R 11/24* (2006.01)

(52) U.S. Cl.
CPC ..... *H01R 11/24* (2013.01)

(58) Field of Classification Search
CPC ..... H01R 11/24
See application file for complete search history.

(56) References Cited

U.S. PATENT DOCUMENTS 2,000,665 A * 5/1935 Neal ..... H01R 11/282 439/440
2,714,198 A * 7/1955 Schloetzer ..... H01R 11/24 439/822
2,731,932 A * 1/1956 Petersen ..... B25B 7/02 81/311
3,850,490 A * 11/1974 Zehr ..... H01R 4/64 439/92
4,153,321 A 5/1979 Pombrol
4,758,188 A 7/1988 Yates
5,046,958 A * 9/1991 Brown ..... H01R 4/64 439/92
5,167,529 A * 12/1992 Verge ..... H01R 11/24 429/1
5,613,884 A * 3/1997 Krivec ..... B25B 7/18 24/518
6,364,719 B1 * 4/2002 Chopra ..... H01R 11/282 439/759
6,638,101 B1 10/2003 Botelho et al.
8,083,555 B2 12/2011 Suiter
9,178,292 B2 11/2015 Stecewycz

FOREIGN PATENT DOCUMENTS

CH 000408147 A * 2/1966 ..... H01R 11/24

* cited by examiner

*Primary Examiner* — Tho D Ta
(74) *Attorney, Agent, or Firm* — Elias Borges

(57) ABSTRACT

Herein is disclosed a jumper cable clamp which includes a housing having an elongated arm having a head portion and a second end configured to mount to the jumper cable and hold the jumper cable in coaxial alignment with the elongated axis. First and second jaws are mounted adjacent the head portion perpendicular to the elongated axis. The first jaw is electrically coupled to the jumper cable. The clamp further includes a lever assembly coupled to one of the first and second jaws for moving the jaw between a clamping position wherein the first and second jaws are sufficiently close together to clamp onto the terminal and an open position wherein the first and second jaws are sufficiently spaced apart to permit the terminal to be free from the jaws. The clamp further includes a lock mechanism for locking the first and second jaws in their clamping position.

17 Claims, 7 Drawing Sheets

Clamp 10
open position

Clamp 10
close position

Main frame 12
side view

Main frame 12
front view

Closing movement of arm 56

Closing movement of arm 56
Zooming view

Zoomed view of clamp 10
in closed position force anaylsis on arm 56
when in closed position

SPRING LOADED LOCKING CLAMP FOR JUMPER CABLES

CROSS REFERENCE TO RELATED APPLICATION

This application claims priority from U.S. provisional application No. 62/826,223 filed on Mar. 29, 2019, the entirety of which is incorporated herein by reference.

FIELD OF THE INVENTION

The invention relates generally to spring loaded locking clamp for jumper cables

BACKGROUND OF THE INVENTION

When the jumper cables are clamped to the objectives, due to the weight of the cables and/or vibration of the engine, the cables could pull and drag the clamps. If the clamp slides off from the objective, it could affect your work and more seriously, it could cause damages to the vehicle. Regular clamps open and close their jaws sideways, and the jaws face the direction perpendicular to the pulling force of the cables. The clamps have to rely on the friction between the jaws and the objective to overcome the pulling force. It is unreliable and unsafe in many cases, especially when working in a vibration situation. The most common solution for this is to increase its spring's tension. But it could not solve the problem efficiently and completely since the increase of the spring's tension is limited, otherwise the clamp would not be able to be operated by hands. Furthermore, significant strong tension makes it more difficult and expensive to manufacture. Other solutions attempt to lock the clamp. But these solutions fail to meet the needs of the industry because their mechanisms lock the objectives with a rigid jaw opening displacement setting rather than applying a constant press force to the contact surfaces. The most of the conductive objectives and the clamp jaws are made of soft materials such as lead, copper, aluminum, zinc or their alloys. And the contact surfaces between the objectives and the teeth of the clamp jaws are small and relatively fragile. When a rigid clamping force is applied, the contact surfaces could become plastic deformation, especially in a vibration situation. Eventually the clamp losses its press force.

SUMMARY OF THE INVENTION

The present invention is directed at an improved jumper cable clamp for use with a set of jumper cables, the jumper cable clamp being configured to securely couple the jumper cable to the terminal of a battery. The jumper cable clamp includes a housing having an elongated arm having opposite first and second ends and an elongated axis. The first end of the arm having a head portion which extends perpendicularly away from the elongated axis and the second end is configured to mount to the jumper cable and hold the jumper cable in coaxial alignment with the elongated axis. A first jaw is mounted to the head portion and oriented perpendicularly to the elongated axis, the first jaw being electrically coupled to the cable. A second jaw is mounted to the housing adjacent the first jaw, the second jaw being aligned with the first jaw and the second jaw being movable between a clamping position wherein the first and second jaws are sufficiently close to each other to clamp the terminal between the jaws and an open position wherein the second jaw is sufficiently spaced from the first jaw to permit the terminal to be free from the jaws. The clamp further includes a lever assembly mounted to the housing and movable between an open and closed position, the lever assembly coupled to the second jaw to move the second jaw between its clamping and open positions when the lever assembly moves between its closed and opened position, respectively. The clamp also includes a biasing member for biasing the second jaw towards its clamping position when the lever arm is in its closed position.

The present invention is also directed at a jumper cable clamp which is constructed such that it resists being dislodged from the terminals of a battery when the attached jumper cable is pulled. In accordance with this aspect of the invention, there is provided a jumper cable clamp which includes a housing having an elongated arm having opposite first and second ends and an elongated axis. The first end of the elongated arm has a head portion and the second end has a mount configured to mount to the jumper cable and hold the jumper cable in coaxial alignment with the elongated axis. First and second jaws are mounted to the housing adjacent the head portion, the first and second jaws being mounted parallel to each other and perpendicular to the elongated axis. The first jaw is electrically coupled to the jumper cable. The clamp further includes a lever assembly coupled to one of the first and second jaws for moving the jaw between a clamping position wherein the first and second jaws are sufficiently close together to clamp onto the terminal and an open position wherein the first and second jaws are sufficiently spaced apart to permit the terminal to be free from the jaws. The clamp further includes a lock mechanism for locking the first and second jaws in their clamping position.

In accordance with another aspect of the present invention, there is provided a jumper cable clamp for use with a jumper cable, the clamp being configured to securely clamp and lock onto a battery terminal to prevent the clamp from accidentally dislodging from the battery terminal. The jumper cable clamp made in accordance with this invention includes a housing having an elongated arm having opposite first and second ends and an elongated axis. The first end has a head portion and the second end has a mount configured to mount to the jumper cable and hold the jumper cable in coaxial alignment with the elongated axis. The clamp further includes a first jaw mounted to the housing adjacent the head portion such that the first jaw is oriented perpendicular to the elongated axis and a second jaw mounted to the housing adjacent the first jaw such that the first and second jaws are positioned opposed to each other. The clamp further includes a lever assembly mounted to the housing for moving the first and second jaws relative to each other between a clamped position wherein the first and second jaws are sufficiently close to each other to firmly clamp the terminal between them, and an open position wherein the first and second jaws are sufficiently spaced apart such that the terminal is free of the jaws. The clamp also includes a locking mechanism for releasably locking the lever assembly when the jaws are in their clamping position.

DRAWINGS

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Clamp for Jumper Cables may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

Figure 1A:
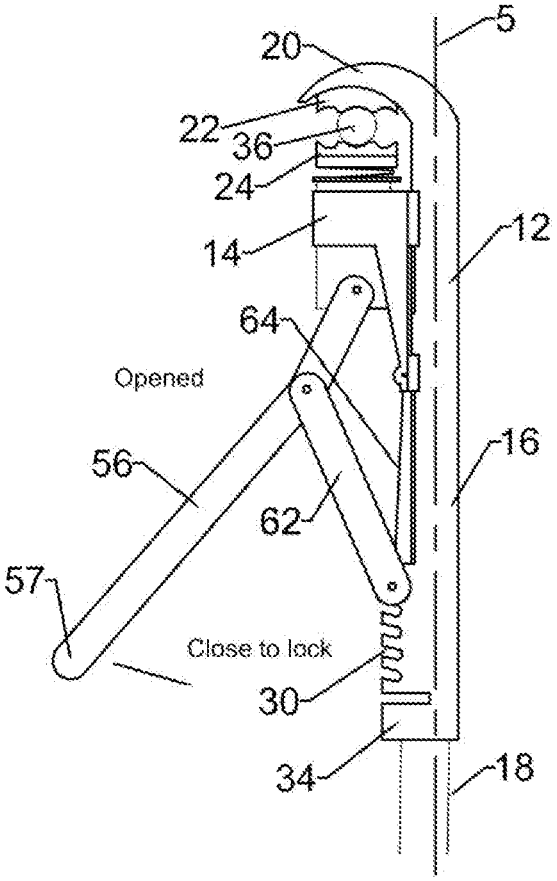
FIG. 1*a* is a side view of a jumper cable clamp made in accordance with the present invention showing the lever mechanism in its open position.
Figure 1B:
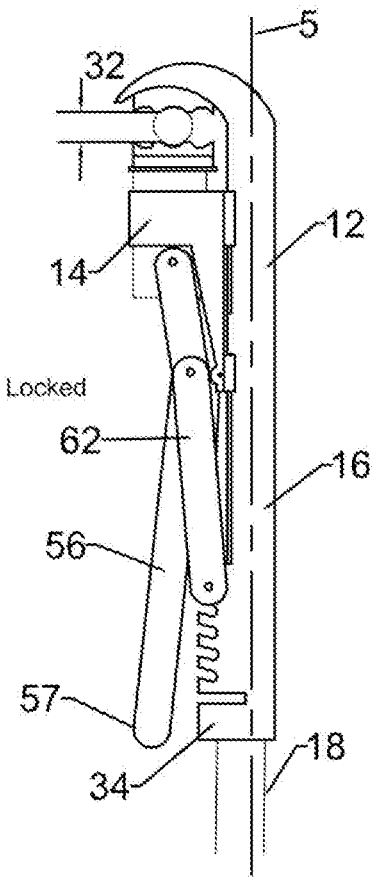
FIG. 1*b* is a side view of the jumper cable clamp shown in FIG. 1*a* showing the lever mechanism in its closed position.

Referring firstly to FIGS. 1*a* and 1*b*, in its most complete version the invention consists of a clamp shown generally as item 10 which is composed of a main frame 12 and a lever assembly 14. The main frame 12 is the main support structure of the clamp and includes an elongated arm portion 16 which has an elongated axis 5 and a U-shaped cross section with a channel to permit the cable 18 to pass through the channel coaxially with axis 5 within the arm portion. Main frame 12 includes several portions including a hook shaped clamp head 20 positioned at a first end of arm portion 16.

Figure 2A:
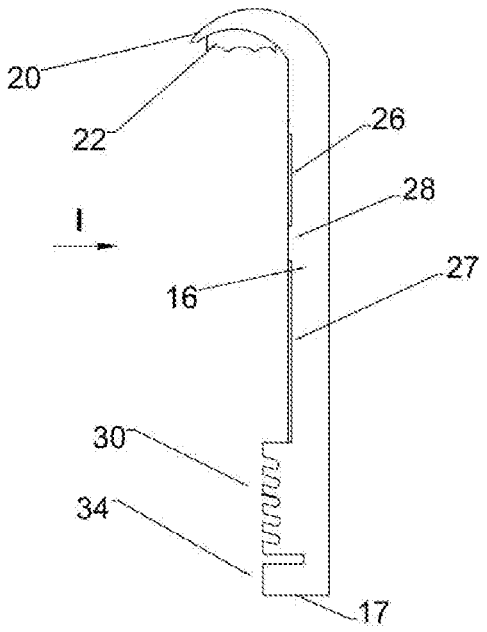
FIG. 2*a* is a side view of the housing portion of the jumper cable clamp shown in FIG. 1*a,*
Figure 2B:
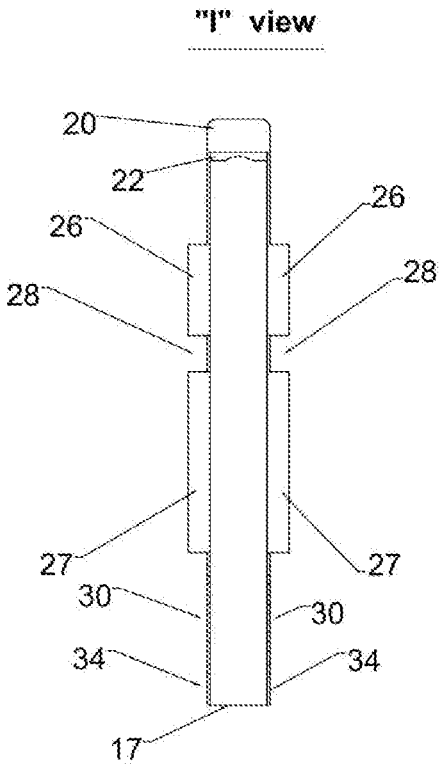
FIG. 2*b* is a front view of the housing portion of the jumper cable clamp shown in FIG. 2*a.*

Clamp head 20 is hook shaped to allow for "grabbing" the objective (battery terminal). Formed on clamp head 20 is the first jaw 22. Clamp head 20 projects perpendicularly relative to the rest of arm 16 (i.e. perpendicularly relative to axis 5) permitting jaws 22 and 24 to be oriented perpendicular to arm 16, which in turn allows the jaws to open and close in a direction parallel to arm 16. The first jaw 22 is installed to the clamp head 20 with rivets, screws, or the like and is electrically coupled to cable 18. Jaw 22 is made of an electrically conductive material such as steel, aluminum or a copper alloy. For greater clarity, reference is made to FIGS. 2*a* and 2*b* which shows frame 12. Arm 16 also includes flanges 26 and 27 which are located between head 20 and end 17 of arm 16. Flanges 26 and 27 are used as sliding tracks for attaching and supporting lever assembly 14. Flange cut-offs 28 are positioned between flanges 26 and 27 and, as described below, allow for the detachment and attachment of the lever assembly 14 to arm 16. As seen in FIG. 2*b*, flanges 26 and 27 project perpendicularly from arm 16 and cut-offs 28 form a gap between the flanges. Referring back to FIGS. 1*a* and 1*b*, also included on arm 16 is a group of forward sloping slots 30, which form an adjustable support point for lever assembly 14. Selectively positioning lever assembly 14 on slots 30 can be used to adjust the size of clamp opening 32. Clamp terminal 34 is positioned at a second end of arm 16 and is configured to be deformable to allow a firm attachment to cable 18 by crimping terminal 34 onto cable 18. This permits the transfer of any pulling force from the cable to clamp 10.

Lever assembly 14 sits and holds on the main frame 12. Lever assembly 14 is movable between an open position as shown in FIG. 1*a* to a closed position as shown in FIG. 1*b*. When moving lever assembly 14 from its open to its closed positions, clamp opening 32 deceases in size. Hence, clamp 10 can be clamped firmly onto battery terminal 36 by moving the lever assembly 14 from its open position to its closed position.

Figure 3A:
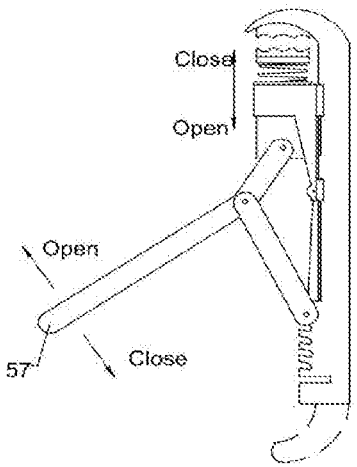
FIG. 3*a* is a side view of the jumper cable clamp shown in FIG. 1 indicating movement of the jaws.
Figure 3B:
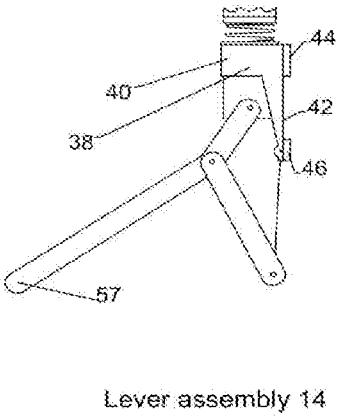
FIG. 3*b* is a side view of the lever assembly portion of the jumper cable clamp shown in FIG. 3*a.*
Figure 3C:
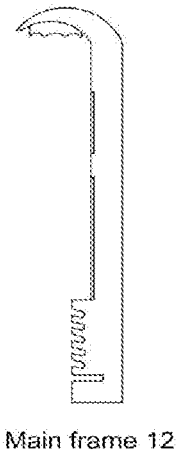
FIG. 3*c* is a side view of the housing portion of the jumper cable clamp shown in FIG. 3*a.*
Figure 4A:
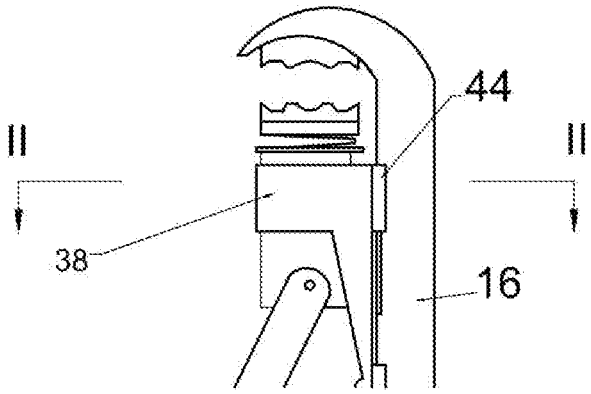
FIG. 4*a* is a side view of the head portion of the jumper cable clamp shown in FIG. 1*a.*
Figure 4B:
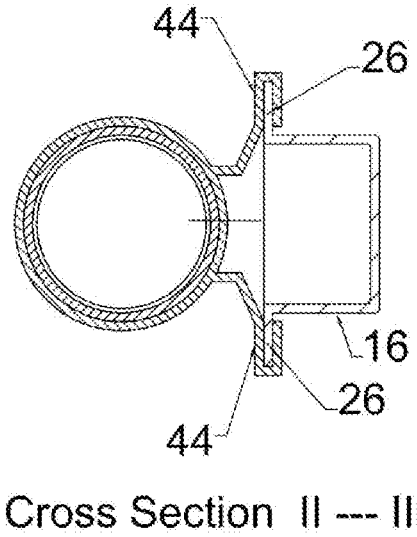
FIG. 4*b* is a cross sectional view taken along line II-II in FIG. 4*a.*

Referring now to FIGS. 3*a*, 3*b* and 3*c*, lever assembly 14 includes a floating housing 38 having an annular portion 40 at one end and an extended portion 42 opposite the annular portion. Floating housing 38 essentially supports the whole lever assembly. Annular portion 40 and extended portion 42 have two pairs of stamp formed right angled C-shape grooves 44 and 46, respectively. The C-shaped grooves are dimensioned and configured to engage flanges 26 and 27 on arm 16 such that the flanges become sliding tracks for the C-shaped grooves and the whole lever assembly can slide along the flanges. Housing 38 is therefore slidingly coupled to arm 16 via C-shaped grooves 44 and 46 and flanges 26 and 27. Housing 38 can be attached and detached to flanges 26 and 27 by aligning the C-shaped grooves with the flange cut-offs 28. For greater clarity, reference is made to FIGS. 4*a* and 4*b*. C-shaped grooves 44 are dimensioned and configured to slidingly retain flanges 26 formed on arm 16 permitting floating housing 38 to slide along arm 16.

Figure 5:
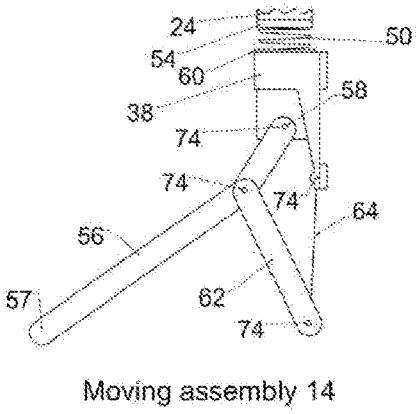
FIG. 5 is a side view of the lever assembly portion of the jumper cable clamp shown in FIG. 1*a.*
Figure 6:
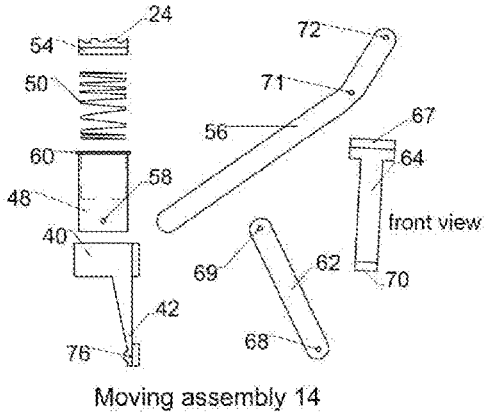
FIG. 6 is a side view of the lever assembly portion of the jumper cable clamp shown in FIG. 5 showing the parts of the lever assembly which has been disassembled.

Referring now to FIGS. 5 and 6, additional parts of the lever assembly shall now be discussed. The lever assembly includes a spring retainer 48 which is configured to receive compression spring 50. Compression spring 50 is in turn coaxially mounted to jaws 24 by coupling 54. Spring retainer 48 is preferably a cylindrical cup like structure mounted to lever arm 56 at pivot point 58. Spring retainer 48 transfers the clamping force from lever arm 56 to compression spring 50. Spring retainer 48 has a round recessed inner chamber for accommodating the compression spring and its overall dimensions are slightly small than the inner dimensions of the annular portion 40 so that the spring retainer can move slightly inside of the annular portion. Spring retainer 48's maximum travel range is limited by joint 58 located at its back portion and a flange 60 at its open end (best seen in FIG. 6). Compression spring 50 is preferably screwed into a bottom of the round recessed inner chamber of spring retainer 48. Compression spring 50 maintains and transfers the clamping force from lever arm 56 to jaw 24 via coupling plate 54. Coupling plate 54 is fixed to spring 50 by means known generally in the art, such as spot welding. Jaw 24 is in turn riveted or screwed to coupling plate 54. Lever arm 56, intermediate arm 62 and linkage bar 64 are linked together via rivets 74 to form a leverage assembly which can be used to apply a mechanical advantage carrying force from handle end 57 of lever arm 56 to jaw 24. In particular, as best seen in FIG. 6, arm 62 has joint points 68 and 69, lever arm 56 has joint points 71 and 72 and linkage bar 64 has joint points 70 and 67. Joint points 70 and 68 are riveted together to link arm 62 and linkage bar 64 together. Joint points 69 and 71 are riveted together to link arm 62 with lever arm 56. Joint points 72 and 58 are riveted together to link lever arm 56 with spring retainer 48 and joint points 67 and 76 are riveted together to link linkage bar 64 to extended portion 42. Lever assembly 14 essentially consists of a lever arm arrangement for translating and magnifying a griping force applied on the handle 57 to a strong clamping force applied by jaw 24. The lever arm and other linkage members are dimensioned to permit a strong clamping force to be applied with a modest gripping force.

Figure 7:
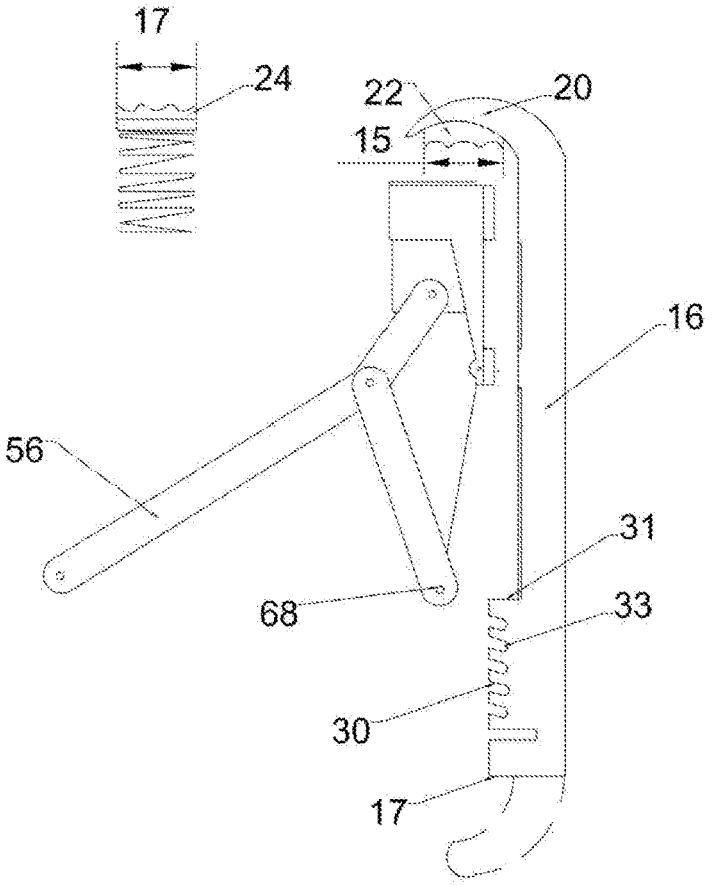
FIG. 7 is a side view of the jumper cable clamp shown in FIG. 1*a* which is partially disassembled.

Referring now to FIG. 7, slots 30 on arm 16 are designed to be used for adjusting the clamp's opening size. Pivot point 68 is provided with projecting portions which are configured to engage within the individual slots 33 to permit the lever assembly 14 to be mounted to arm 16. When pivot point 68 is engaged it into different sloped slots 30 on arm 16, the clamp will be given different opening sizes. The space between the jaws adjacent head 20 can be preselected to be as wide as possible if pivot point 68 is coupled to one of the slots 30 closest to end 17. If pivot point 68 is instead engaged to one of the slots 30 closest to portion 31 of arm 16, then space between the jaws will be as narrow as possible. Hence, it is possible to adjust clamp 10 to work with different sized battery terminals simply be selecting on which of slots 30 the lever assembly 14 is to be mounted on.

As also seen in FIG. 7, jaw 24 has a width 17 and jaw 22 has a width 15. Preferably the width of jaws 22 and 24 are approximately equal. More importantly, jaws 22 and 24 are mounted in clamp 10 such that jaw 22 is positioned perpendicular to axis 5 of arm 16 and the width of jaw 22 extends perpendicularly away from axis 5. Preferably both jaws 22 and 24 are oriented parallel to each other with both of the jaws mounted perpendicularly relative to axis 5.

Regardless of which of slots 30 the lever assembly 14 is mounted on, pushing lever arm 56 towards arm 16 causes jaw 24 to move towards jaw 22 with significant force and causes gap 32 to narrow.

Figure 8A:
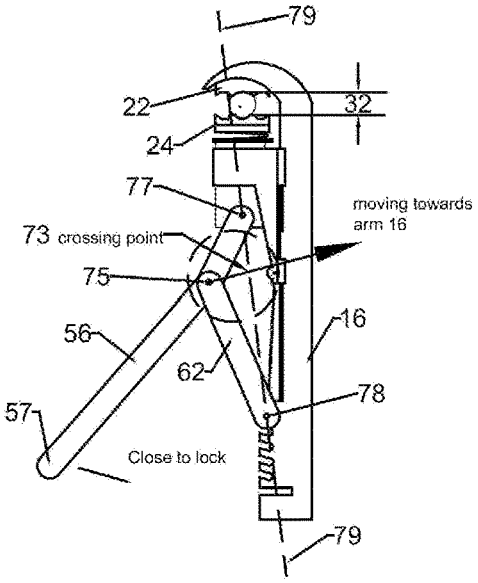
FIG. 8*a* is a side view of the closing movement of the jumper cable clamp shown in FIG. 1*a.*
Figure 8B:
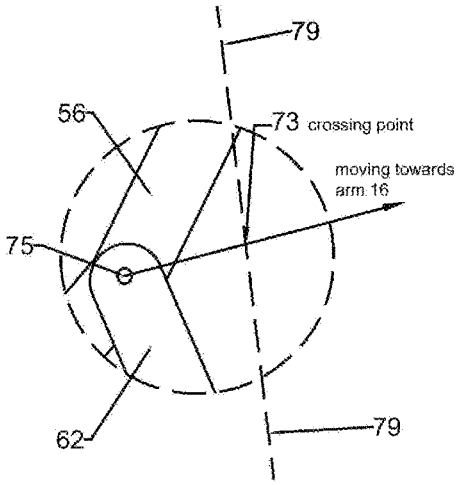
FIG. 8*b* is a zoomed in view of portion Z of FIG. 8*a.*
Figure 8C:
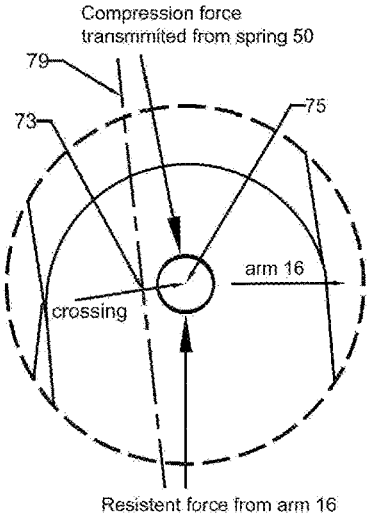
FIG. 8*c* is a further zoomed in view of item 75 of the jumper cable clamp in its locked position.
Figure 8D:
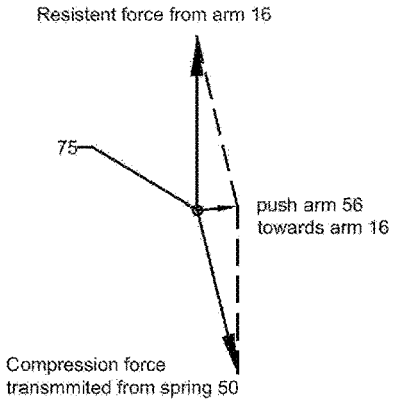
FIG. 8*d* is a schematic view showing the force analysis of closed jumper cable clamp in FIG. 8*c.*

Referring to FIGS. 8*a* and 8*b*, for explaining more easily, a straight reference line 79 is introduced and it connects the coupling point 77 and 78. When arm 56 is moving towards arm 16, its second coupling point 75 is moving towards arm 16 and going to cross reference line 79 at point 73. When point 75 arrives at point 73, it is in line with the first coupling point 77 and the linkage arm 62. At this position, joint 77 reaches its most forward position, jaw 24 reaches the maximum forward travel distance and the clamp reaches its maximum clamping force. To lock the mechanism more securely near this position, it is desired to push and pivot arm 56 slightly further closer to arm 16 (best seen in FIG. 8*c*), hence point 75 is positioned closer to arm 16 than point 73 when arm 56 is in its fully closed position. As diagramed in FIG. 8*d*, at this closer position, the transmitted compression force from spring 50 and resistant force from arm 16 push the point 75 towards arm 16. It assures that arm 56 will be biased towards arm 16 and stay in its fully closed position such that an outwardly directed force will have to be applied to arm 56 to move it back into its opened position.

Arm 16 can have blockers and tabs designed to prevent the handle's further pivoting towards arm 16 and to gently bear against the arm when the arm is in its fully closed position. When the arm reaches the blocker/tab, then clamp 10 is nearly in its maximum clamping force position, and it is also in a secure and stable locked position and it can be referred to as being in its designated locking position.

The arms 56 and 62 and linkage 64 are all dimensioned such that when arm 56 is closest to arm 16, the clamp 10 is biased into its designated locking position The Operation of the clamp shall now be discussed with reference to FIGS. 1*a* and 1*b*. Clamp 10 can be assembled before attaching it to the battery terminals by first attaching lever assembly 14 onto arm 16. Lever assembly 14 is positioned onto arm 16 by selecting which slot in slots 30 to attach the lever assembly to and then ensuring that C-shaped grooves 44 and 46 are coupled to flanges 26 and 27, respectively. The clamp is then placed into its fully opened position by ensuring that arm 56 is away from arm 16 so as to maximize gap 32 between jaws 22 and 24. Battery terminal 36 is then placed between jaws 22 and 24 and arm 56 is placed into its closed position. Jaws 24 moves towards jaws 22 and the terminal is trapped between the jaws and held secure. When the clamp is thus clamped to terminal 36, jaws 22 and 24 are positioned perpendicular to the long axis of arm 16. Cable 18 is mounted to end 17 of arm 16 and is held in coaxial alignment with arm 16 such that pulling on cable 18 is resisted by the fact that head 20 and jaws 22 and 24 are at a right angle to the cable. Therefore, in addition to the considerable gripping force being applied to terminal 36 resisting the accidental dislodging of the terminal from the jaws of the clamp, the positioning of the jaws at a right angle relative to cable 18 ensures that the jaws and head 20 act as a hook keeping the clamp secure on the terminal and preventing the terminal from slipping off of clamp 10. Terminal 36 is securely held in place when arm 56 is placed into its fully closed position since the clamp is essentially locked into its closed position by the biasing force keeping arm 56 in its fully closed position. The compression spring in clamp 10 ensures that arm 56 stays in its fully closed position until the arm is forced into its open position. To release the terminal, arm 56 is then moved back to its fully opened position as shown in FIG. 1*a*.

For storage (without clamping any objective): Fully open the handle and engage the shifting rivet into the first slot, then close the handle fully to the locking position. The clamp is now locked in this status and takes up the smallest space. It is the designated storage position. At this status, the spring is about half way compressed.

Figure 9:
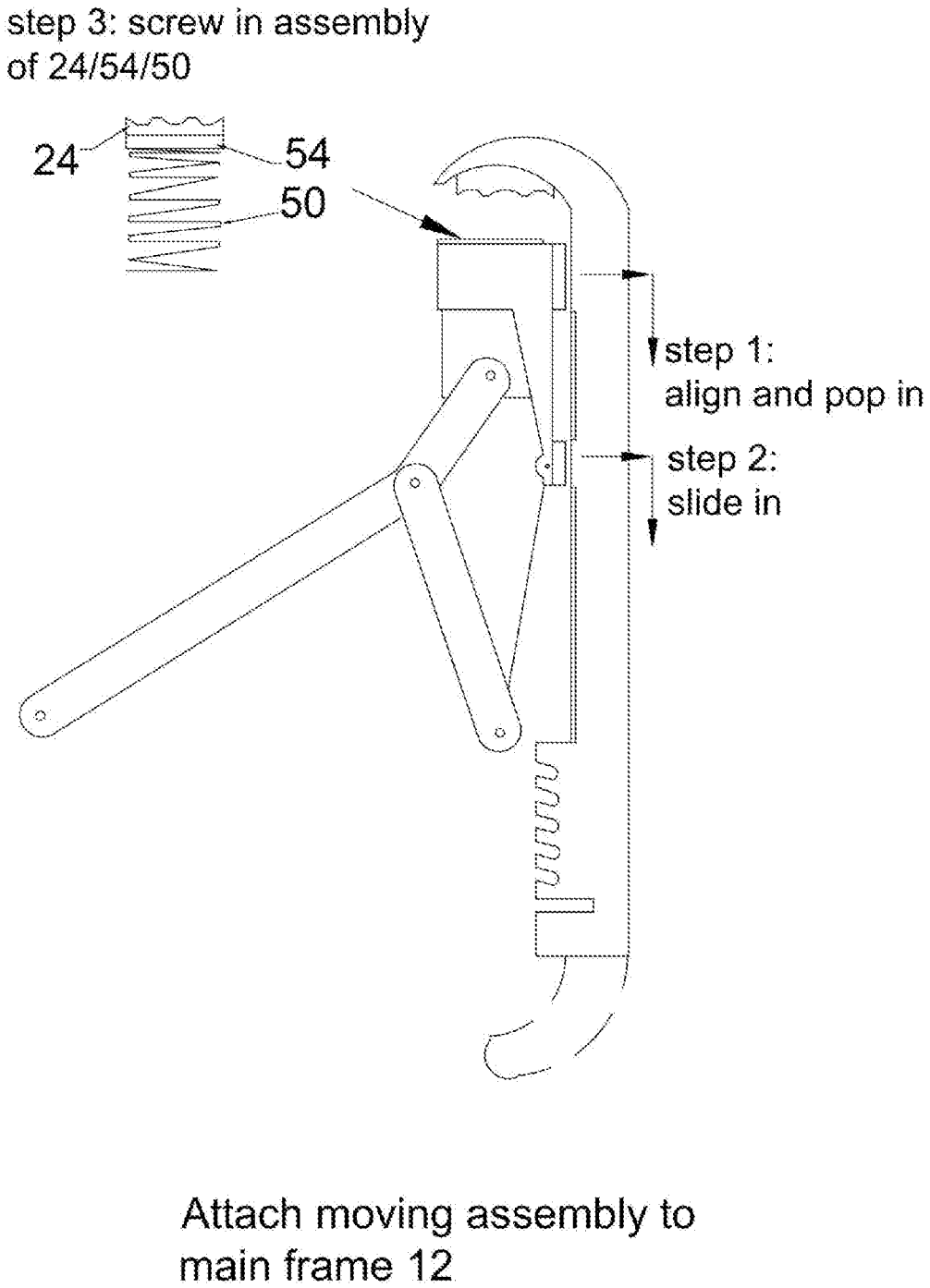
FIG. 9 is an assembling diagram of the jumper cable clamp.

Attaching the lever assembly to the main frame: referring to FIG. 9, without the assembly of the second jaw 24, plate 54 and spring 50 installed, align the grooves on the housing with the flange cut-off on the main frame. Pop the grooves into the cut-offs, match the grooves with the flanges. Slide the grooves into the sliding tracks formed by the flanges. Finally, screw in the assembly of 24, 54 and 50. Now the clamp has been assembled. To detach the lever assembly from the main frame, just processing in the reversed order.

Figure 10A:
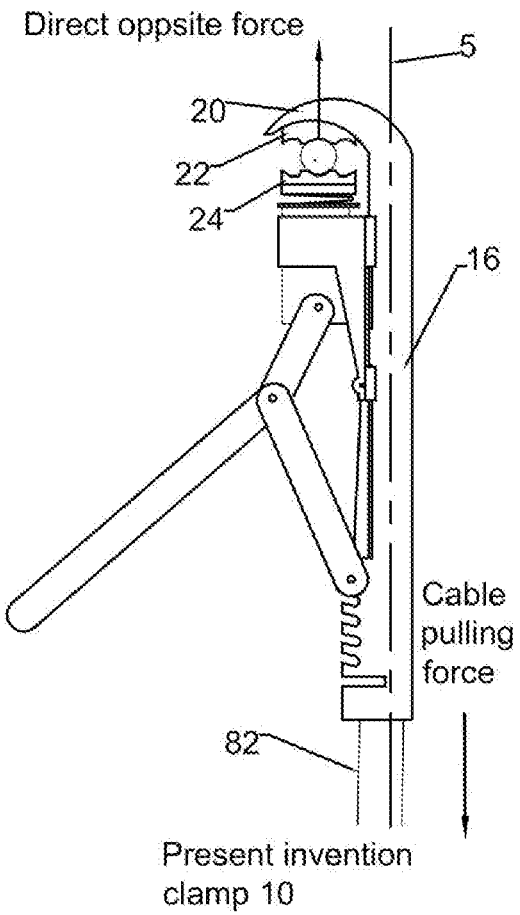
FIG. 10*a* is a side view of a jumper cable clamp made in accordance with the present invention.
Figure 10B:
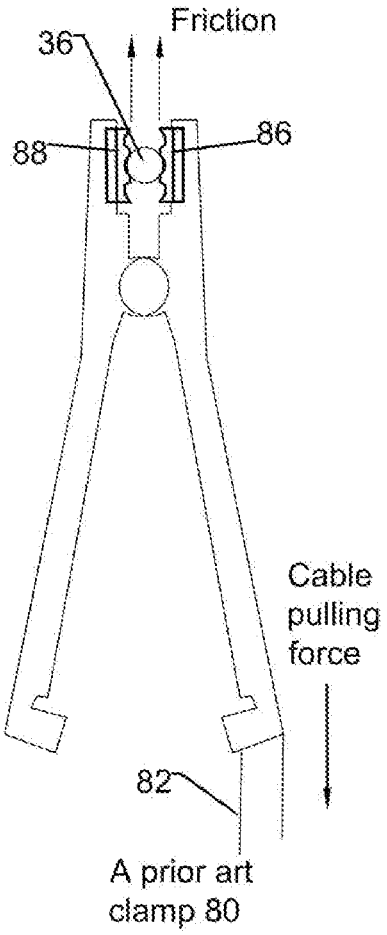
FIG. 10*b* is a side view of a prior art jumper cable clamp.

Referring now to FIGS. 10*a* and 10*b*, the present invention has several advantages over the prior art. Comparing the prior art clamp shown generally as item 80 to clamp 10 made in accordance this invention, it is clear how the two differ on how they overcome the cable's pulling force. Regular clamps (item 80) open and close their jaws 88 and 86 in a sideways fashion. Jaws 88 and 86 are positioned parallel to cable 82 and the clamping force applied by these jaws to terminal 36 is directed at a roughly perpendicular angle relative to cable 82. Clamp 80 has to rely on the friction between jaws 88/86 and terminal 36 to overcome the pulling force applied by cable 82. It is unreliable and unsafe in many cases, especially when working in a vibrating situation. In the clamp made in accordance with the present invention (clamp 10), the clamp positions jaws 22 and 24 at a roughly perpendicular angle relative elongated axis 5 of arm 16, which in turn mounts cable 18 in coaxial alignment with axis 5. Since cable 18 is mounted coaxially with arm 16 and since jaws 22 and 24 are positioned roughly perpendicular to axis 5, clamp 10 is therefore better at resisting any pulling force applied by cable 18. Essentially, head portion 20 and jaws 22 act as a hook preventing terminal 36 from being dislodged even if cable 18 is pulled with significant force. The design of clamp 10 ensures that the cable pulling force is transferred onto the jaw contact surface in the direct opposite direction to the force applied by the cable.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

Therefore, what is claimed is:

1. A jumper cable clamp for coupling a jumper cable to a terminal of a battery, the jumper cable clamp comprising:

a. a housing having an elongated arm having opposite first and second ends and an elongated axis, the first end having a head portion which extends perpendicularly away from the elongated axis and the second end configured to mount to the jumper cable and hold the jumper cable in coaxial alignment with the elongated axis;

b. a first jaw mounted to the head portion and oriented perpendicularly to the elongated axis, the first jaw being electrically coupled to the cable;

c. a second jaw mounted to the housing adjacent the first jaw, the second jaw being aligned with the first jaw, the second jaw movable between a clamping position wherein the first and second jaws are sufficiently close to each other to clamp the terminal between the jaws and an open position wherein the second jaw is sufficiently spaced from the first jaw to permit the terminal to be free from the jaws;

d. a lever assembly mounted to the housing and movable between an open and closed position, the lever assembly coupled to the second jaw to move the second jaw between its clamping and open positions, when the lever assembly moves between its closed and opened position, respectively, and e. a biasing member for biasing the second jaw towards its clamping position when the lever arm is in its closed position, and f. wherein the lever assembly comprises a lever arm having a opposite first and second ends, the first end of the lever arm being pivotally coupled to the second jaw at a first coupling point, a handle being formed on the second end of the lever arm, the lever arm being pivotally coupled to a link arm having opposite first and second ends, the first end of the link arm being pivotally coupled to the lever arm at a second coupling point on the lever arm, the second coupling point being between the lever arms first and second ends, the second end of the link arm being pivotally coupled to the elongated arm.

2. The jumper cable clamp defined in claim 1 wherein the biasing member comprises a compression spring coupled between the second jaw and the first coupling point.

3. The jumper cable clamp defined in claim 2 wherein the compression spring is mounted in a retainer member which is in turn held within a floating housing which is slidingly attached to the elongated arm.

4. The jumper cable clamp defined in claim 2 wherein the lever arm and linkage arm are dimensioned and configured such that the lever arm is positioned away from the elongated arm when the lever arm is in its opened position and the lever arm is positioned adjacent the elongated arm when the lever arm is in its closed position.

5. The jumper cable clamp defined in claim 4 wherein the lever arm and linkage arm are further dimensioned and configured such that when the lever arm is fully in its closed position, the second coupling point is closer to the elongated arm than the point at which it is in line with the first coupling point and the linkage arm, and when the lever arm is moved towards its opened position the second coupling point is further away from the elongated arm than the point at which it is in line with the first coupling point and the linkage arm, the positioning of the first and second coupling points and its position relative to the elongated arm when the lever arm is fully in its closed position forming a lock mechanism biasing the lever arm into its closed position.

6. The jumper cable clamp defined in claim 5 wherein the compression spring is mounted in a retainer member which is in turn held within a floating housing which is slidingly attached to the elongated arm, the first coupling point being formed on the retainer member.

7. A jumper cable clamp for coupling a jumper cable to a terminal of a battery, the jumper cable clamp comprising:

a. a housing having an elongated arm having opposite first and second ends and an elongated axis, the first end having a head portion and the second end having a mount configured to mount to the jumper cable and hold the jumper cable in coaxial alignment with the elongated axis;

b. first and second jaws mounted to the housing adjacent the head portion, the first and second jaws being mounted parallel to each other and perpendicular to the elongated axis;

c. a lever assembly coupled to one of the first and second jaws for moving said jaw between a clamping position wherein the first and second jaws are sufficiently close together to clamp onto the terminal and an open position wherein the first and second jaws are sufficiently spaced apart to permit the terminal to be free from the jaws;

d. a lock mechanism for locking the first and second jaws in their clamping position, and e. wherein the lever assembly comprises a lever arm having a opposite first and second ends, the first end of the lever arm being pivotally coupled to the second jaw at a first coupling point, a handle being formed on the second end of the lever arm, the lever arm being pivotally coupled to a link arm having opposite first and second ends, the first end of the link arm being pivotally coupled to the lever arm at a second coupling point on the lever arm, the second coupling point being between the lever arms first and second ends, the second end of the link arm being pivotally coupled to the elongated arm.

8. The jumper cable clamp defined in claim 7 wherein the biasing member comprises a compression spring coupled between the second jaw and the first coupling point.

9. The jumper cable clamp defined in claim 8 wherein the compression spring is mounted in a retainer member which is in turn held within a floating housing which is slidingly attached to the elongated arm.

10. The jumper cable clamp defined in claim 8 wherein the lever arm and linkage arm are dimensioned and configured such that the lever arm is positioned away from the elongated arm when the lever arm is in its opened position and the lever arm is positioned adjacent the elongated arm when the lever arm is in its closed position.

11. The jumper cable clamp defined in claim 10 wherein the lever arm and linkage arm are further dimensioned and configured such that when the lever arm is fully in its closed position, the second coupling point is closer to the elongated arm than the point at which it is in line with the first coupling point and the linkage arm, and when the lever arm is moved towards its opened position the second coupling point is further away from the elongated arm than the point at which it is in line with the first coupling point and the linkage arm, the positioning of the first and second coupling points and its position relative to the elongated arm when the lever arm is fully in its closed position forming the lock mechanism, the lock mechanism biasing the lever arm into its closed position.

12. The jumper cable clamp defined in claim 11 wherein the compression spring is mounted in a retainer member which is in turn held within a floating housing which is slidingly attached to the elongated arm, the first coupling point being formed on the retainer member.

13. A jumper cable clamp for coupling a jumper cable to a terminal of a battery, the jumper cable clamp comprising:

a. a housing having an elongated arm having opposite first and second ends and an elongated axis, the first end having a head portion and the second end having a mount configured to mount to the jumper cable and hold the jumper cable in coaxial alignment with the elongated axis;

b. a first jaws mounted to the housing adjacent the head portion such that the first jaw is oriented perpendicular to the elongated axis;

c. a second jaw mounted to the housing adjacent the first jaw such that the first and second jaws are positioned opposed to each other;

d. a lever assembly mounted to the housing for moving the first and second jaws relative to each other between a clamped position wherein the first and second jaws are sufficiently close to each other to firmly clamp the terminal between them, and an open position wherein the first and second jaws are sufficiently spaced apart such that the terminal is free of the jaws, and e. a locking mechanism for releasably locking the lever assembly when the jaws are in their clamping position, and f. wherein the lever assembly comprises a lever arm having a opposite first and second ends, the first end of the lever arm being pivotally coupled to the second jaw at a first coupling point, a handle being formed on the second end of the lever arm, the lever arm being pivotally coupled to a link arm having opposite first and second ends, the first end of the link arm being pivotally coupled to the lever arm at a second coupling point on the lever arm, the second coupling point being between the lever arms first and second ends, the second end of the link arm being pivotally coupled to the elongated arm.

14. The jumper cable clamp defined in claim 13 wherein the biasing member comprises a compression spring coupled between the second jaw and the first coupling point.

15. The jumper cable clamp defined in claim 14 wherein the lever arm and linkage arm are dimensioned and configured such that the lever arm is positioned away from the elongated arm when the lever arm is in its opened position and the lever arm is positioned adjacent the elongated arm when the lever arm is in its closed position.

16. The jumper cable clamp defined in claim 15 wherein the lever arm and linkage arm are further dimensioned and configured such that when the lever arm is fully in its closed position, the second coupling point is closer to the elongated arm than the point at which it is in line with the first coupling point and the linkage arm, and when the lever arm is moved towards its opened position the second coupling point is further away from the elongated arm than the point at which it is in line with the first coupling point and the linkage arm, the positioning of the first and second coupling points and its position relative to the elongated arm when the lever arm is fully in its closed position forming the lock mechanism, the locking mechanism biasing the lever arm into its closed position.

17. The jumper cable clamp defined in claim 16 wherein the compression spring is mounted in a retainer member which is in turn held within a floating housing which is slidingly attached to the elongated arm.

* * * * *